US010238183B1

(12) United States Patent
Taylor

(10) Patent No.: US 10,238,183 B1
(45) Date of Patent: Mar. 26, 2019

(54) BELT ADJUSTMENT SYSTEM

(71) Applicant: SlideBelts Inc., El Dorado Hills, CA (US)

(72) Inventor: Brigham Thomas Taylor, El Dorado Hills, CA (US)

(73) Assignee: SLIDEBELTS INC., El Dorado Hills, CA (US)

( * ) Notice: Subject to any disclaimer, the term of this patent is extended or adjusted under 35 U.S.C. 154(b) by 162 days.

(21) Appl. No.: 15/166,986

(22) Filed: May 27, 2016

Related U.S. Application Data

(63) Continuation of application No. 13/974,984, filed on Aug. 23, 2013, now Pat. No. 9,351,526, which is a continuation-in-part of application No. 13/860,439, filed on Apr. 10, 2013, now Pat. No. 9,149,090.

(60) Provisional application No. 61/624,244, filed on Apr. 13, 2012.

(51) Int. Cl.

| | |
|---|---|
| ***A44B 11/16*** | (2006.01) |
| ***A44B 11/12*** | (2006.01) |
| ***A41F 9/00*** | (2006.01) |
| ***A41F 9/02*** | (2006.01) |

(52) U.S. Cl.
CPC ..... *A44B 11/125* (2013.01); *A41F 9/002* (2013.01); *A41F 9/025* (2013.01); *A44B 11/16* (2013.01)

(58) Field of Classification Search
CPC ..... A44B 11/006; A44B 11/06; A44B 11/001; Y10T 24/3413; Y10T 24/4016; Y10T 24/4037; Y10T 24/404; Y10T 24/4098; Y10T 24/4736; A41F 9/02; A41F 9/025
See application file for complete search history.

(56) References Cited

U.S. PATENT DOCUMENTS

| | | | |
|---|---|---|---|
| 2,110,684 | A | 3/1938 | Schuhmann |
| D167,823 | S | 9/1952 | Bliss |
| 2,802,248 | A | 8/1957 | Wallace |
| 3,152,374 | A | 10/1964 | Round |
| 3,466,668 | A | 9/1969 | Ochiai |
| 4,249,267 | A | 2/1981 | Voss |
| 4,669,155 | A | 6/1987 | Chen |
| 5,181,300 | A | 1/1993 | Schwarz |
| 5,572,747 | A | 11/1996 | Cheng |
| 5,579,563 | A | 12/1996 | Sim |
| 5,588,184 | A | 12/1996 | Chen |
| 5,588,186 | A | 12/1996 | Ko |
| 5,806,145 | A | 9/1998 | Chen |
| 5,839,170 | A | 11/1998 | Cho |
| 6,067,662 | A | 5/2000 | Sim |
| 6,081,973 | A | 7/2000 | Liu |
| 6,148,485 | A | 11/2000 | Wu |
| D453,125 | S | 1/2002 | Citton |
| 6,457,210 | B1 | 10/2002 | Shirai et al. |
| 6,898,826 | B2 | 5/2005 | Draper et al. |
| D508,872 | S | 8/2005 | Hoeppner |
| 7,032,415 | B2 | 4/2006 | Young |
| 7,246,383 | B2 | 7/2007 | Musal |
| 7,254,872 | B2 | 8/2007 | Ross |
| D625,656 | S | 10/2010 | Kosh et al. |

(Continued)

*Primary Examiner* — Gloria Hale
(74) *Attorney, Agent, or Firm* — Knobbe, Martens, Olson & Bear, LLP

(57) ABSTRACT

A belt includes an inside belt surface, a belt coating layer provided on the inside belt surface and a plurality of belt teeth in the belt coating layer. A belt adjustment system and a belt fabrication method are also disclosed.

19 Claims, 11 Drawing Sheets

(56) References Cited

U.S. PATENT DOCUMENTS

| | | | | |
|---|---|---|---|---|
| 8,056,192 | B1 | 11/2011 | Posner | |
| 8,146,211 | B2 | 4/2012 | Shirai et al. | |
| 8,689,364 | B2 | 4/2014 | Rowland et al. | |
| D727,204 | S | 4/2015 | Laatz | |
| 9,149,090 | B1 | 10/2015 | Taylor | |
| D743,841 | S | 11/2015 | Laatz | |
| D748,012 | S | 1/2016 | Laatz | |
| 9,351,526 | B1 * | 5/2016 | Taylor | A44B 11/12 |
| 9,370,223 | B1 * | 6/2016 | Taylor | A41F 9/02 |
| D776,568 | S | 1/2017 | Taylor | |
| 2009/0178256 | A1 | 7/2009 | Toth | |
| 2012/0036618 | A1 | 2/2012 | Rowland | |
| 2013/0167288 | A1 | 7/2013 | Rowland et al. | |

* cited by examiner

BELT ADJUSTMENT SYSTEM

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

FIELD OF THE INVENTION

Illustrative embodiments of the disclosure generally relate to buckles for fastening belts. More particularly, illustrative embodiments of the disclosure relate to a belt with integrated adjustment slots for a dual-lever ratchet buckle and belt adjustment system which facilitates ease and convenience for a user in selectively tightening and fastening a belt around the waist of a user, and to a belt fabrication method.

BACKGROUND OF THE INVENTION

Conventional belt adjustment systems may utilize a single lever which actuates an adjustment mechanism that interacts with grooved teeth on a belt. The adjustment mechanism allows the belt to be adjusted along a continuum of diameters to accommodate waists of corresponding sizes. However, utilization of a single lever to actuate the adjustment mechanism may be cumbersome for some users. Due to the manner in which the adjustment mechanism interacts with the teeth in the belt, the user may be required to depress the lever of the buckle with extreme force while dislodging the belt from the adjustment mechanism in a back-and-forth motion. Belts which are used with ratcheting or sliding adjustment mechanisms may use a slotted track and a molded plastic insert which is sewn into the inside of the belt.

A belt with integrated adjustment slots for a dual-lever ratchet buckle and belt adjustment system which facilitates ease and convenience for a user in selectively tightening and fastening a belt around the waist of a user, and a belt fabrication method may be desirable.

SUMMARY OF THE INVENTION

Illustrative embodiments of the disclosure are generally directed to a belt. An illustrative embodiment of the belt includes an inside belt surface, a belt coating layer provided on the inside belt surface and a plurality of belt teeth in the belt coating layer.

Illustrative embodiments of the disclosure are further generally directed to a belt adjustment system. An illustrative embodiment of the belt adjustment system comprises a belt including an inside belt surface, a belt coating layer provided on the inside belt surface and a plurality of belt teeth in the belt coating layer; a belt clamp carried by the belt; a buckle carried by the belt clamp, the buckle accommodating the belt; a lever pivotally carried by the buckle; a tooth-engaging tab carried by the lever, the tooth-engaging tab positional between a tooth-engaging position wherein the tooth-engaging tab engages one of the plurality of belt teeth and a tooth-disengaging position wherein the tooth engaging tab disengages one of the plurality of belt teeth responsive to pivoting of the lever on the buckle; and a tab biasing mechanism normally biasing the tooth-engaging tab in the tooth-engaging position.

Illustrative embodiments of the disclosure are further generally directed to a belt fabrication method. An illustrative embodiment of the belt fabrication method includes providing a belt blank having an inside belt surface, applying a belt coating layer on the inside belt surface, providing a belt die having a plurality of die teeth and forming a plurality of belt teeth in the belt coating layer by pressing the plurality of die teeth of the belt die into the belt coating layer.

BRIEF DESCRIPTION OF THE DRAWINGS

Illustrative embodiments of the disclosure will now be described, by way of example, with reference to the accompanying drawings, in which.

DETAILED DESCRIPTION OF THE PREFERRED EMBODIMENT

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is nonlimiting and is not necessarily to be construed as preferred or advantageous over other implementations. All of the implementations described below are exemplary implementations provided to enable persons skilled in the art to practice the disclosure and are not intended to limit the scope of the appended claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description. Relative terms such as "front" and "rear" as used herein are intended for descriptive purposes only and are not necessarily intended to be construed in a limiting sense.

Figure 8:
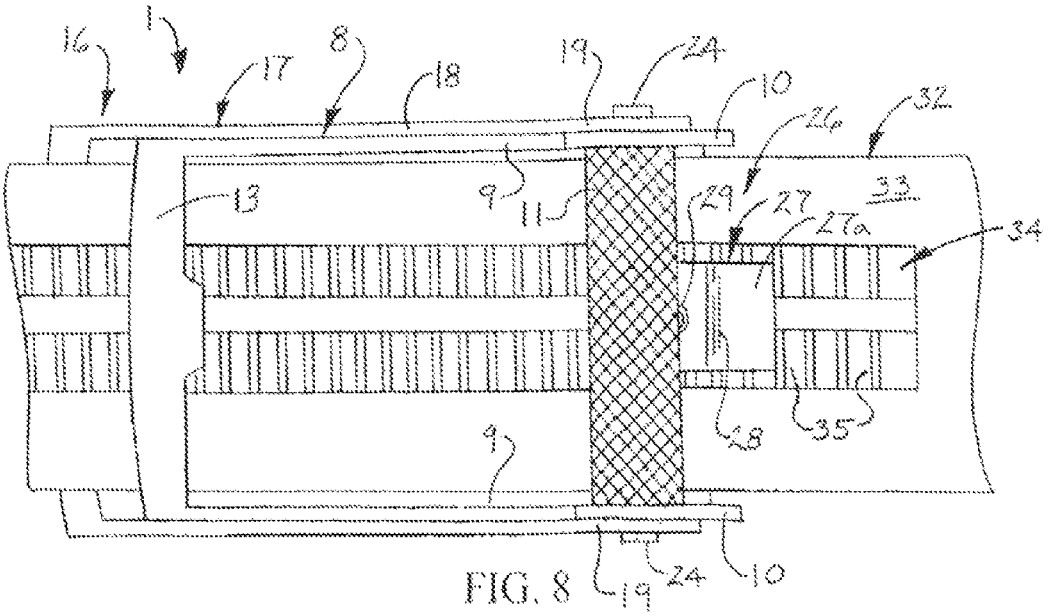
FIG. 8 is a bottom view of an illustrative embodiment of the belt adjustment system provided on a belt.
Figure 11:
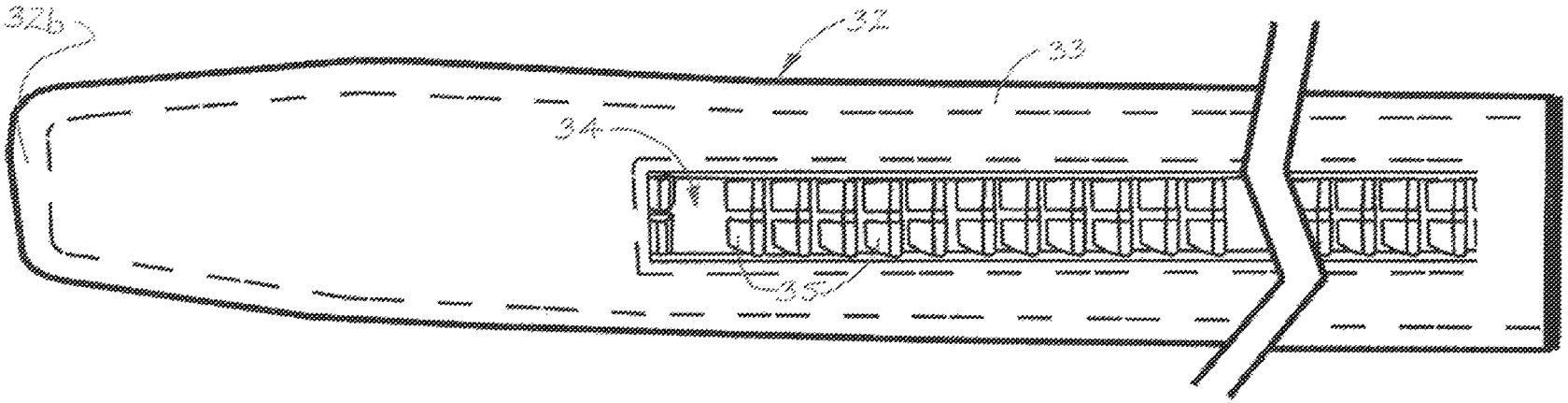
FIG. 11 is a view of the inside surface of an exemplary belt, partially in section, which is suitable for implementation of an illustrative embodiment of the belt adjustment system.
Figure 12:
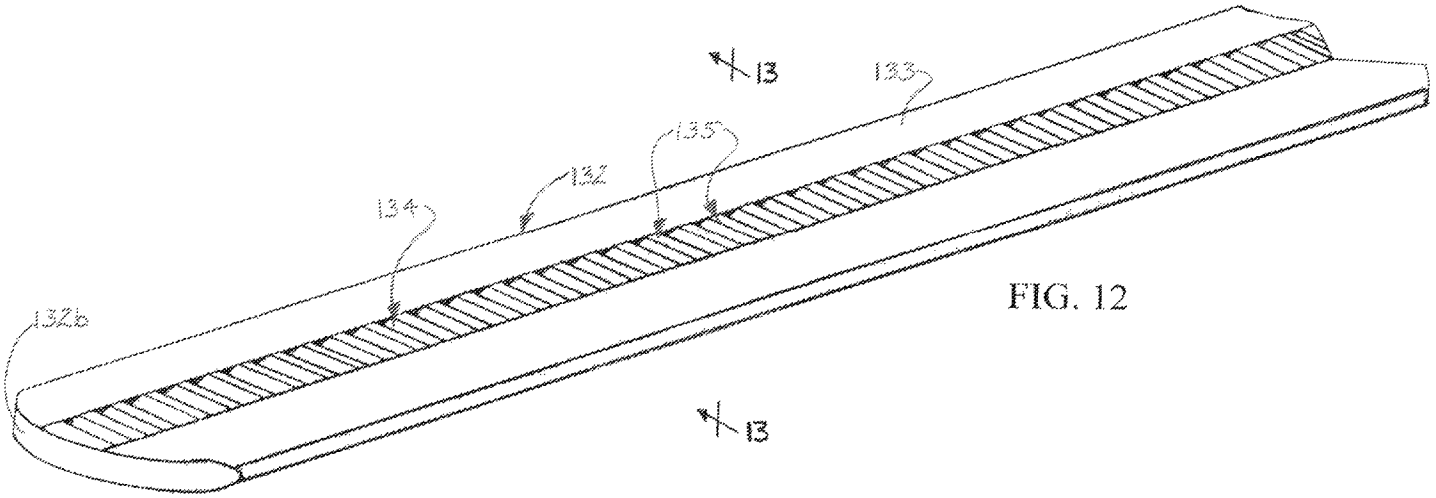
FIG. 12 is a perspective view of the inside surface of an alternative exemplary belt, partially in section, which is suitable for implementation of an illustrative embodiment of the belt adjustment system.

Referring to the drawings, an illustrative embodiment of the belt adjustment system is generally indicated by reference numeral 1. As will be hereinafter described, the belt adjustment system 1 facilitates ease and convenience for a user (not illustrated) in selective adjustment of a belt 32 around the waist of a user. As illustrated in FIGS. 8 and 11, the belt 32 may have an inside belt surface 33 which faces the waist of the user. An elongated belt groove 34 extends along at least a portion of the inside belt surface 33. Multiple, spaced-apart belt teeth 35, which may be plastic or other material, are provided in the belt groove 34. The belt adjustment system 1 engages the belt teeth 35 in the belt groove 34 to secure the belt 32 at a selected diameter around the waist of the user, as will be hereinafter further described.

Figure 1:
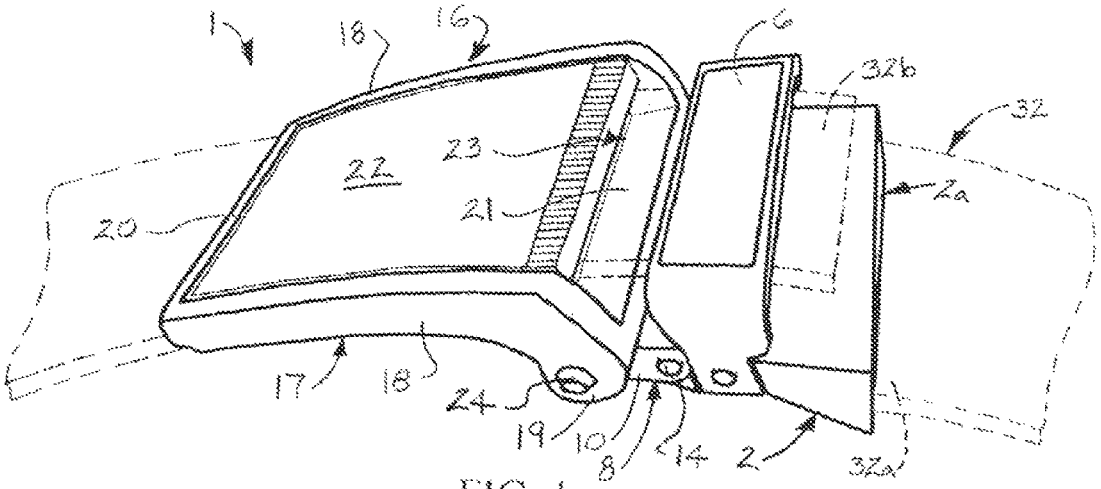
FIG. 1 is a top perspective view of an illustrative embodiment of the belt adjustment system provided on a belt (illustrated in phantom)

As illustrated in FIGS. 1-5, the belt adjustment system 1 includes a belt clamp 2. In some embodiments, the belt clamp 2 may have a belt clamp interior 2*a* (FIG. 1). A tab opening 5 (FIG. 2) in the belt clamp 2 may communicate with the clamp interior 2*a*. A belt tooth tab 3 may be pivotally attached to the belt clamp 2 adjacent to the tab opening 5. Multiple belt teeth 4 may extend from the belt tooth tab 3. The belt tooth tab 3 may be positional between an open, belt releasing configuration illustrated in FIG. 2, in which the belt tooth tab 3 is unseated from the tab opening 5 and the belt teeth 4 are disposed outside the belt clamp interior 2*a*, and a closed, belt engaging configuration (FIG. 1) in which the belt tooth tab 3 is seated in the tab opening 5 and the belt teeth 4 extend into the belt clamp interior 2*a*. In use of the belt adjustment system 1, which will be hereinafter described, the belt teeth 4 are adapted to engage and secure an attachment end 32*a* of the belt 32 (illustrated in phantom) which is inserted in the belt clamp interior 2*a* of the belt clamp 2 to attach the belt adjustment system 1 to the belt 32. A belt stay 6 may be attached to the belt clamp 2 to secure a free adjustable end 32*b* of the belt 32, as will be hereinafter described. In other embodiments, the belt clamp 2 may have any design which facilitates attachment of the belt adjustment system 1 to the attachment end 32*a* of the belt 32 according to the knowledge of those skilled in the art.

Figure 2:
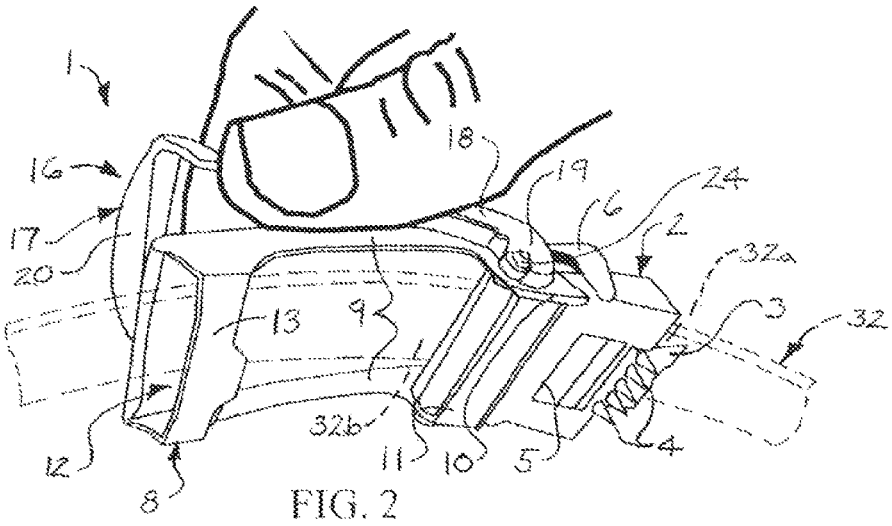
FIG. 2 is a bottom perspective view of an illustrative embodiment of the belt adjustment system provided on a belt (illustrated in phantom)
Figure 4:
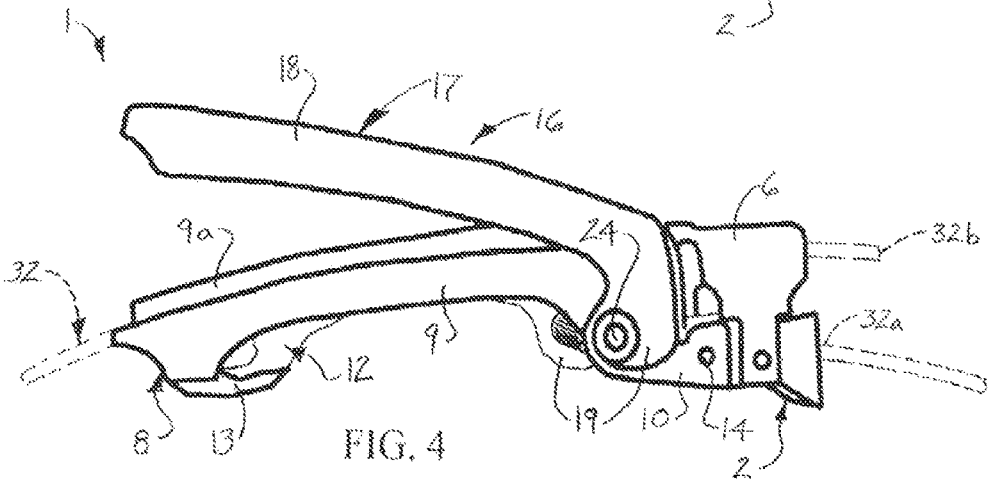
FIG. 4 is a side view of an illustrative embodiment of the belt adjustment system, provided on a belt (illustrated in phantom) and deployed in a belt-releasing configuration.
Figure 5:
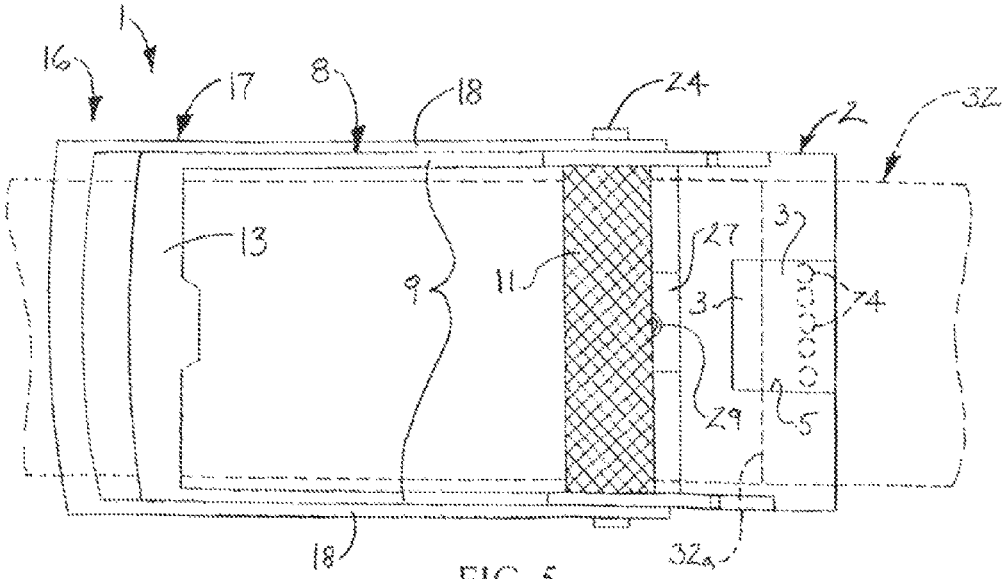
FIG. 5 is a bottom view of an illustrative embodiment of the belt adjustment system, provided on a belt (illustrated in phantom)

A buckle 8 is attached to the belt clamp 2. As illustrated in FIG. 2, the buckle 8 may include a pair of elongated, parallel, spaced-apart side buckle members 9 which terminate in a pair of buckle flanges 10, respectively. The buckle flanges 10 may be attached to opposite sides of the belt clamp 2 such as via a pair of buckle fasteners 14. As further illustrated in FIG. 2, a front connecting member 11 and a rear connecting member 13 may extend between the side buckle members 9 in generally parallel, spaced-apart relationship to each other. The side buckle members 9, the front connecting member 11 and the rear connecting member 13 together form a belt space 12 which accommodates the adjustment end 32*b* of the belt 32. In some embodiments, a pair of lever seat flanges 9*a* (one of which is illustrated in FIG. 4) may extend from the respective side buckle members 9 for purposes which will be hereinafter described.

Figure 9:
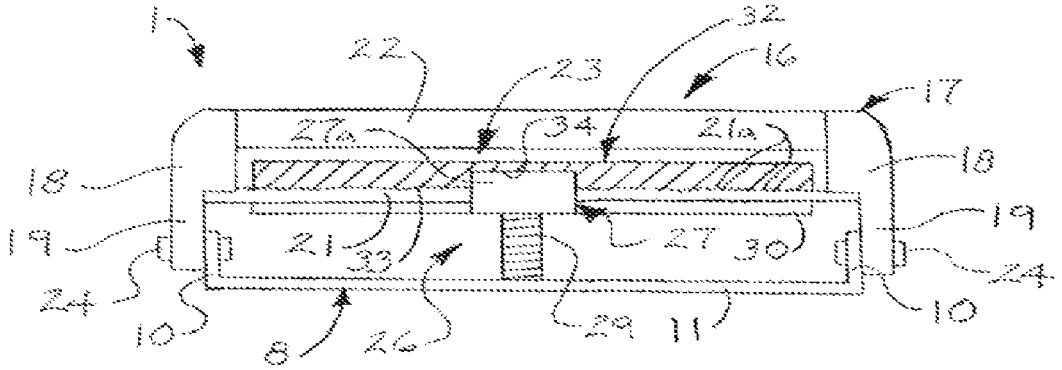
FIG. 9 is a front view, taken along viewing lines 9-9 in FIG. 6, of an illustrative embodiment of the belt adjustment system deployed in the belt-securing configuration.
Figure 10:
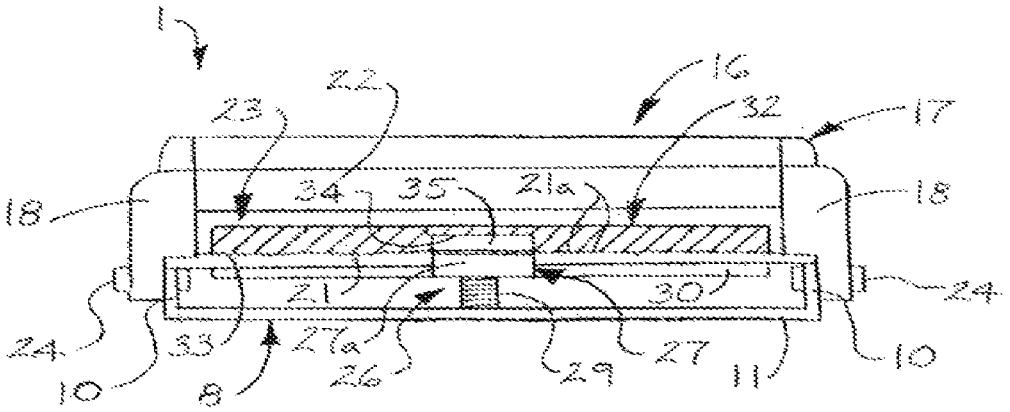
FIG. 10 is a front view, taken along viewing lines 10-10 in FIG. 7, of an illustrative embodiment of the belt adjustment system deployed in the belt-releasing configuration.

A lever 16 is pivotally attached to the buckle 8. As illustrated in FIG. 1, the lever 16 may include a lever frame 17 which may be generally elongated and rectangular. The lever frame 17 may have a pair of generally elongated, parallel, spaced-apart side lever frame members 18 which terminate in a pair of lever frame flanges 19. The lever frame flanges 19 may be pivotally attached to the buckle flanges 10, respectively, of the buckle 8 via pivot pins 24. A connecting frame member 20 may extend between the spaced-apart rear ends of the side lever frame members 18. As illustrated in FIG. 1, a belt engaging member 21 extends between the spaced apart lever frame flanges 19 on the respective front ends of the side lever frame members 18. Accordingly, as the lever 16 is pivoted between the belt-securing configuration illustrated in FIGS. 3 and 9 and the belt-releasing configuration illustrated in FIGS. 4 and 10, the belt engaging member 21 pivots along with the lever 16. A lever plate 22 may be mounted in the lever frame 17. As illustrated in FIGS. 9 and 10, a belt slot 23 may be formed by and between the side lever frame members 18, the belt-engaging member 21 and the lever plate 22. The belt slot 23 is sized and configured to accommodate the belt 32 in use of the belt adjustment system 1. Multiple serrations 21*a* may be provided on the belt engaging member 21 in facing relationship to the belt slot 23.

Figure 6:
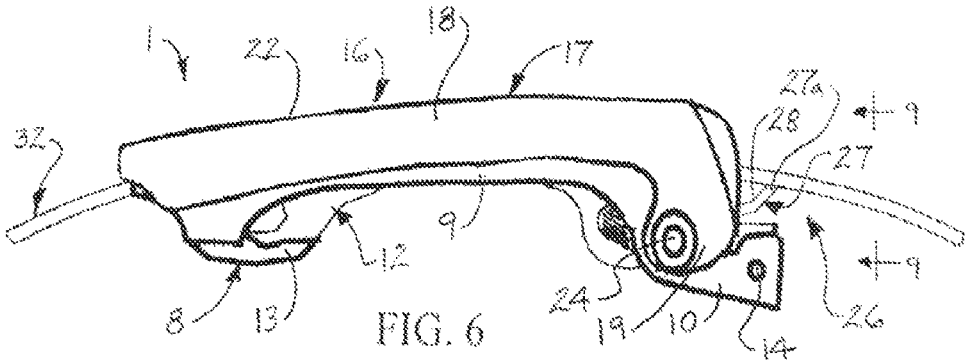
FIG. 6 is a side view of an illustrative embodiment of the belt adjustment system provided on a belt and deployed in the belt-securing configuration, with a belt clamp removed from the belt adjustment system for clarity.
Figure 7:
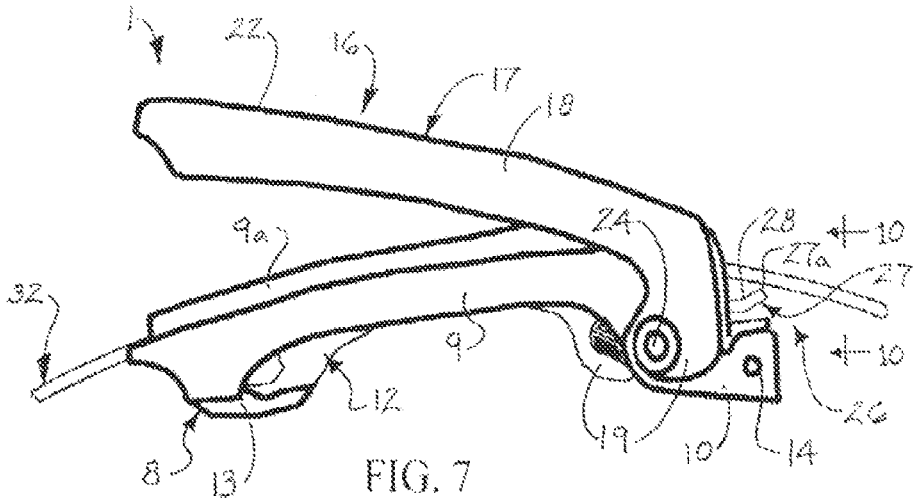
FIG. 7 is a side view of an illustrative embodiment of the belt adjustment system provided on a belt and deployed in the belt-releasing configuration, with the belt clamp removed from the belt adjustment system for clarity.

As further illustrated in FIGS. 9 and 10, a belt engaging assembly 26 may include a tab plate 30 which is provided on the belt engaging member 21. A generally elongated tooth engaging tab 27 having a distal tab end 27*a* extends from the tab plate 30. As illustrated in FIGS. 6 and 7, the tooth-engaging tab 27 may have a tab bend 28, from which the angled distal tab end 27*a* extends forwardly. When the lever 16 is deployed in the belt-securing configuration illustrated in FIG. 9, the distal tab end 27*a* is disposed adjacent to the belt slot 23 and inserts in the belt groove 34 in the inside belt surface 33 of the belt 32 and engages one of the belt teeth 35, preventing movement of the belt 32 through the belt slot 23 and the belt space 12 of the buckle 8. Conversely, when the lever 16 is deployed in the belt-releasing configuration illustrated in FIG. 10, the distal tab end 27*a* of the tooth-engaging tab 27 clears the belt slot 23 and disengages the belt groove 34 and the belt teeth 35, facilitating free back-and-forth movement of the belt 32 through the belt slot 23 and the belt space 12.

A tab biasing mechanism such as a coiled tab spring 29, for example and without limitation, is sandwiched between the front connecting member 11 of the buckle 8 and the tab plate 30. Accordingly, the tab spring 29 normally biases the tooth-engaging tab 27 in the groove insert position illustrated in FIG. 9 and the lever 16 in the buckle-engaging configuration illustrated in FIGS. 3 and 6. Conversely, the lever 16 can be selectively pivoted against the bias which is imparted by the tab spring 29 to the buckle-disengaging configuration illustrated in FIGS. 4 and 7 such that the tooth-engaging tab 27 disengages the belt groove 34 and the belt teeth 35 in the belt 32. When the lever 16 is deployed in the buckle-engaging configuration, the spaced-apart side lever frame members 18 of the lever frame 17 may be nested on the outsides of the lever seat flanges 9*a*, respectively, on the buckle 8.

In exemplary use of the belt adjustment system 1, the attachment end 32*a* of the belt 32 is inserted in the belt clamp interior 2*a* of the belt clamp 2 with the clamp tooth tab 3 initially disposed in the open configuration illustrated in FIG. 2. The clamp tooth tab 3 is then pivoted to the closed position illustrated in FIG. 5 such that the clamp teeth 4 extend into the belt clamp interior 2*a* and engage and secure the attachment end 32*a* of the belt 32 in the belt clamp 2. The free adjustable end 32*b* and the remaining unsecured portion of the belt 32 may then be inserted through belt loops (not illustrated) in the pants of a user typically in the conventional manner.

Figure 3:
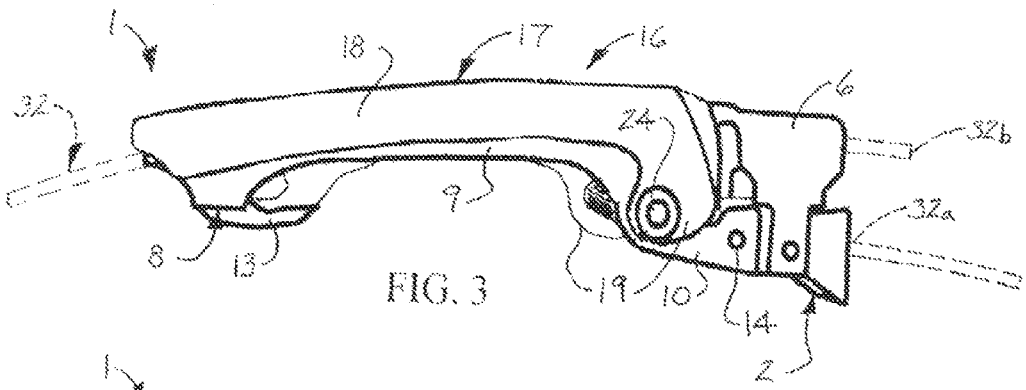
FIG. 3 is a side view of an illustrative embodiment of the belt adjustment system provided on a belt (illustrated in phantom) and deployed in a belt-securing configuration.

The tab spring 29 normally biases the tooth-engaging tab 27 in the tooth-engaging position illustrated in FIG. 9 and the lever 16 in the buckle-engaging position illustrated in FIGS. 3 and 6. Therefore, the lever 16 is manually pivoted to the buckle-disengaging position illustrated in FIGS. 4 and 7 such that the tooth-engaging tab 27 is deployed in the tooth disengaging position illustrated in FIG. 10 to enable free passage of the belt 32 through the belt slot 23 and the belt space 12 of the belt adjustment system 1. Accordingly, the free adjustable end 32*b* of the belt 32 is inserted through the belt space 12 in the buckle 8 and then through the registering belt slot 23 (FIG. 9) and the belt stay 6, respectively, on the belt clamp 2. The lever 16 is then released such that the tab spring 29 returns the lever 16 to the buckle-engaging position such that the distal tab end 27*a* of the tooth-engaging tab 27 inserts into the belt groove 34 and engages one of the belt teeth 35 (FIG. 8) in the belt groove 34. Therefore, the tooth engaging tab 27 prevents further movement of the belt 32 through the belt slot 23 and secures the belt 32 at a selected size or diameter around the waist of the user. The user can selectively subsequently pivot the lever 16 against the bias imparted by the tab spring 29 to the buckle disengaging position to disengage the tooth-engaging tab 27 from the belt teeth 35 and the belt groove 34 and facilitate free movement of the adjustable end 32*b* of the belt 32 through the belt slot 23 until the belt 32 is tightened or loosened according to the preferences of the user. The lever 16 can subsequently again be released such that the tab spring 29 returns the tooth engaging tab 27 to the tooth-engaging position in the belt groove 34 and the lever 16 to the buckle-engaging position to secure the belt 32 at the selected size or diameter.

It will be appreciated by those skilled in the art that the belt adjustment system 1 allows a user to actuate the lever 16 with one hand to selectively tighten or loosen the belt 32. The belt adjustment system 1 can be selectively removed from the belt 32 by disengaging the clamp teeth 4 on the clamp tooth tab 3 from the attachment end 32*a* of the belt 32, pivoting the lever 16 to the belt-releasing position and sliding the adjustable end 32*b* of the belt 32 from the belt slot 23 (FIGS. 9 and 10) and the belt space 12 (FIG. 2).

Figure 13:
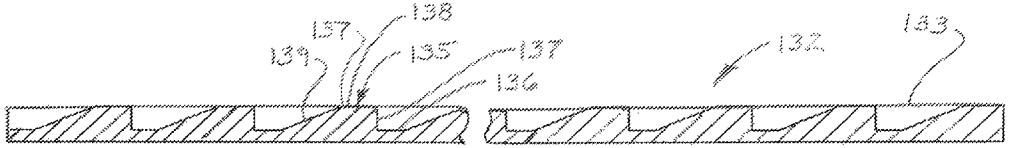
FIG. 13 is a longitudinal sectional view, taken along section lines 13-13 in FIG. 12.
Figure 14:
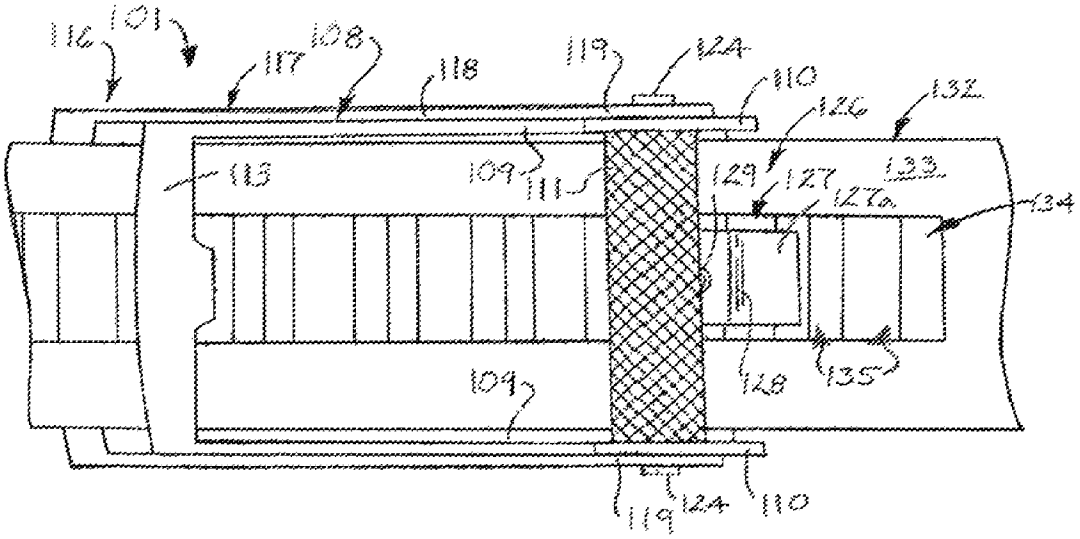
FIG. 14 is a bottom view of an illustrative embodiment of the belt adjustment system, provided on the belt illustrated in FIGS. 12 and 13.
Figure 14A:
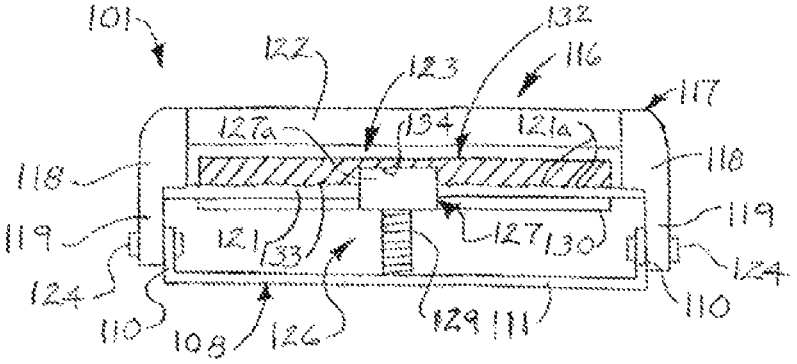
FIG. 14A is a front view of an illustrative embodiment of the belt adjustment system, provided on the belt illustrated in FIGS. 12 and 13 and deployed in the belt-securing configuration.
Figure 14B:
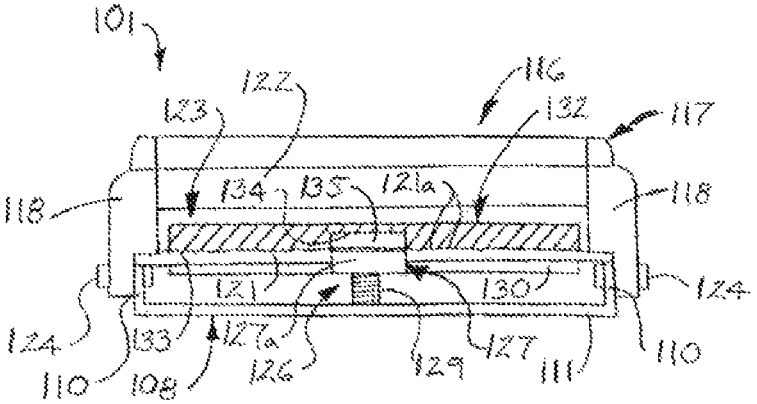
FIG. 14B is a front view of an illustrative embodiment of the belt adjustment system provided on the belt illustrated in FIGS. 12 and 13 and deployed in the belt-releasing configuration.
Figure 14C:
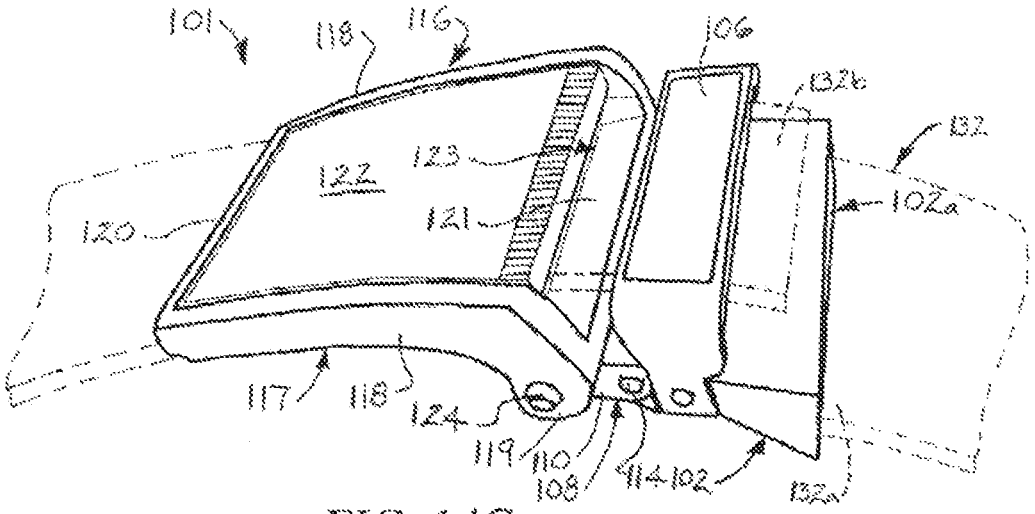
FIG. 14C is a top perspective view of an illustrative embodiment of the belt adjustment system provided on the belt illustrated in FIGS. 12 and 13 (illustrated in phantom)
Figure 14D:
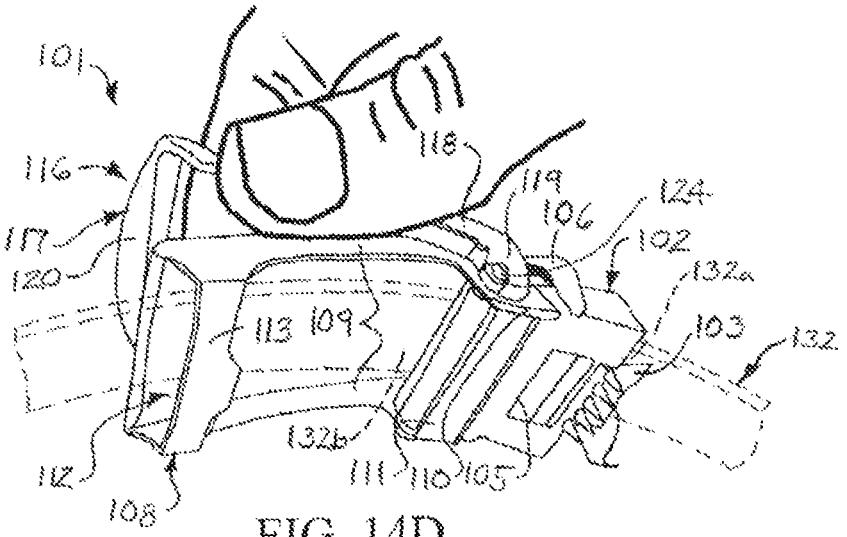
FIG. 14D is a bottom perspective view of an illustrative embodiment of the belt adjustment system provided on the belt illustrated in FIGS. 12 and 13 (illustrated in phantom)

Referring next to FIGS. 12-14D of the drawings, an alternative belt which is suitable for implementation of an illustrative embodiment of the belt adjustment system 101 (FIG. 14) is generally indicated by reference numeral 132. The belt adjustment assembly 101 may have a design which is the same as or similar to that of the assembly 1 that was heretofore described with respect to FIGS. 1-11. Accordingly, in the belt adjustment assembly 101, elements which are analogous to the respective elements of the assembly 1 are designated by the same numeral in the 100 series in FIGS. 12-14. A belt 132 which is suitable for implementation of the belt adjustment system 101 includes an inside belt surface 133. A generally elongated, rectangular belt groove 134 is provided in the inside belt surface 133. Multiple belt teeth 135 are provided in the belt groove 134. The belt teeth 135 may span the width of the belt groove 134 in adjacent, spaced-apart relationship to each other. As illustrated in FIG. 13, in some embodiments, belt adjustment slots 136 may separate adjacent belt teeth 135 from each other in the belt groove 134. Each belt tooth 135 may include a generally flat or planar tab stop surface 137 which is generally perpendicular to a plane of the inside belt surface 133, a generally flat or planar tooth outer surface 138 which extends forwardly from the tab stop surface 137 and is generally parallel to the plane of the inside belt surface 133 and a sloped or beveled tab slide surface 139 which extends forwardly from the tooth outer surface 138 and is opposite the tab stop surface 137 and sloped relative to the inside belt surface 133.

Exemplary use of the belt adjustment system 101 may be as was heretofore described with respect to the belt adjustment system 1. The tab spring 129 normally biases the tooth engaging tab 127 in the tooth-engaging position and the lever 116 in the buckle-engaging position (FIGS. 3 and 6). Therefore, the lever 116 is manually pivoted to the buckle-disengaging position (FIGS. 4 and 7) such that the tooth-engaging tab 127 is deployed in the tooth disengaging position (FIG. 10) to enable free passage of the belt 132 through the belt slot 123 of the belt adjustment system 101. The lever 116 is released such that the tab spring 129 returns the lever 116 to the buckle-engaging position and the distal tab end 127*a* of the tooth-engaging tab 127 inserts into the belt groove 134 and engages the tab stop surface 137 (FIG. 13) of one of the belt teeth 135 in the belt groove 134. Therefore, the tooth-engaging tab 127 prevents further movement of the belt 132 and secures the belt 132 at a selected size or diameter around the waist of the user. The user can selectively pull the belt 132 through the belt slot 123 of the belt adjustment system 101 to tighten the belt 132 around the waist of the user without pivoting the lever 116 such that the tooth-engaging tab 127 slides along the tab slide surfaces 139 of the respective belt teeth 135 and catches on the tab stop surface 137 of one of the belt teeth 135 to stop the belt 132 at the selected diameter. Alternatively, the user can selectively pivot the lever 116 against the bias imparted by the tab spring 129 to the buckle-disengaging position to disengage the tooth-engaging tab 127 from the belt teeth 135 and the belt groove 134 and facilitate free movement of the adjustable end 132*b* of the belt 132 through the belt slot 123 until the belt 132 is tightened or loosened according to the preferences of the user. The lever 116 can subsequently again be released such that the tab spring 129 returns the tooth-engaging tab 127 to the tooth-engaging position in the belt groove 134 and the lever 116 to the buckle-engaging position to secure the belt 132 at the selected size or diameter.

Figure 15:
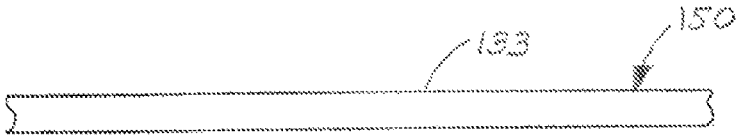
FIGS. 15-17 illustrate sequential fabrication of a belt according to an illustrative embodiment of a belt fabrication method.

Referring next to FIGS. 15-19 of the drawings, sequential fabrication of a belt 132 according to an illustrative embodiment of a belt fabrication method is illustrated. In FIG. 15, a belt blank 150 having a selected length is provided. The belt blank 150 may be a webbing strap material of polyester, nylon or other suitable material. The belt blank 150 has an inside belt surface 13 3.

Figure 16:
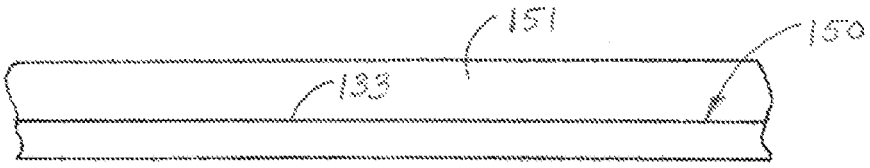

In FIG. 16, a belt coating layer 151 is provided on the inside belt surface 133 of the belt blank 150. The belt coating layer 151 may be rubber, plastic or other moldable or deformable material. The belt coating layer 151 may be applied to the inside belt surface 133 by immersion or other coating or deposition processes known by those skilled in the art.

Figure 17:
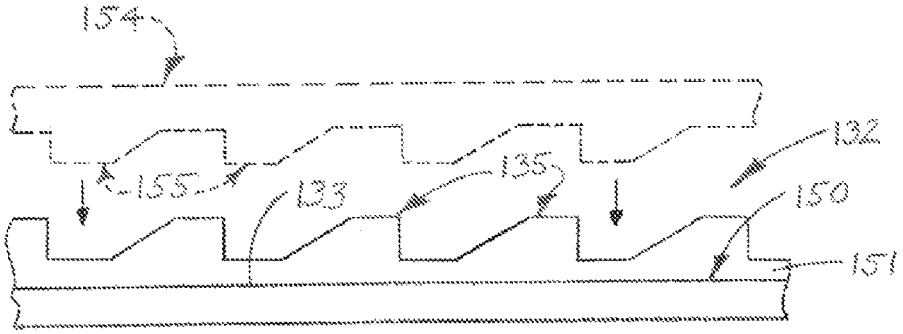
Figure 18:
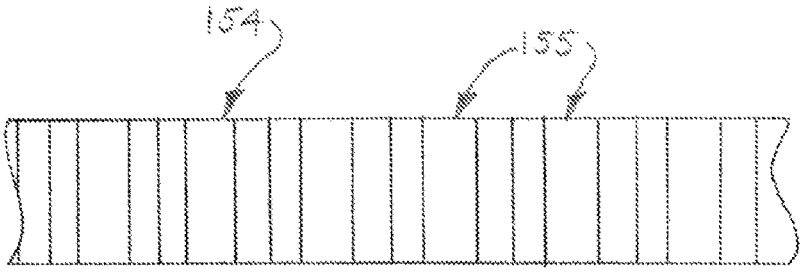
FIG. 18 is an inside surface view of an exemplary die which is suitable for fabrication of the belt illustrated in FIGS. 12 and 13 according to an illustrative embodiment of a belt fabrication method.
Figure 19:
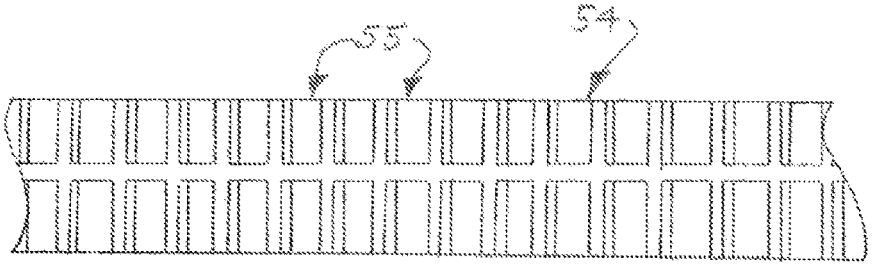
FIG. 19 is an inside surface view of an exemplary die which is suitable for fabrication of the belt illustrated in FIG. 11 according to an illustrative embodiment of a belt fabrication method.

In FIG. 17, a belt die 154 is applied to the belt coating layer 151 to form the belt groove 134 and the belt teeth 135. The belt die 154 has multiple die teeth 155 which are complementary mirror-images of the belt teeth 135 which are formed in the belt coating layer 151. An inside surface view of an exemplary belt die 154 which is suitable for the purpose of forming the belt groove 134 and the belt teeth 135 in the belt 132 is illustrated in FIG. 18. An inside surface view of an exemplary belt die 55 which is suitable for the purpose of forming the belt groove 34 and the belt teeth 35 in the belt 32 which was heretofore described with respect to FIGS. 1-11 is illustrated in FIG. 18. Post-processing steps may include curing of the belt coating layer 151 according to the knowledge of those skilled in the art.

In some embodiments of the method, the structural webbing and the plastic belt coating layer 151 and the imprinting of the belt groove 134 and the belt teeth 135 in the belt coating layer 151 may be formed in a continuous process. Therefore, lengths of the belt 132 of greater than 100 feet and up to 1000 feet may be fabricated in a continuous operation. Thereafter, the individual belts 132 may be cut to the exact length, as needed, and shorter-length belts may be cut from a continuous roll of integrated belt material. The fabrication process may be significantly more economical than conventional processes used to fabricate slotted and ratchet operable or slide belts. The method may eliminate the need to sew a separate plastic slotted strip into the inside belt surface 133 of the belt 132.

Figure 20:
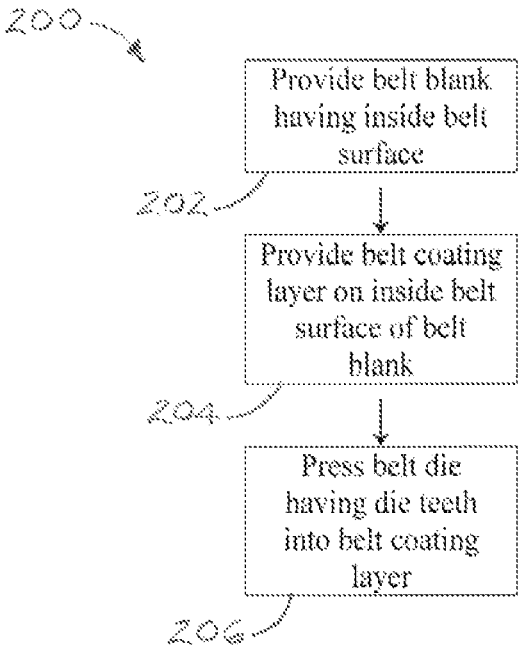
FIG. 20 is a flow diagram of an illustrative embodiment of a belt fabrication method.

Referring next to FIG. 20 of the drawings, a flow diagram 200 of an illustrative embodiment of a belt fabrication method is illustrated. In block 202, a belt blank having an inside belt surface is provided. In some embodiments, the belt blank may be a webbing strap material of polyester, nylon or other suitable material. In block 204, a belt coating layer is provided on the inside belt surface of the belt blank. The belt coating layer may be rubber, plastic or other moldable or deformable material. In block 206, a belt die having die teeth is pressed into the belt coating layer to form the belt groove and the belt teeth in the belt coating layer. In some embodiments, the belt groove and the belt teeth may be formed in the belt coating layer in a continuous process.

While the embodiments of the disclosure have been described above, it will be recognized and understood that various modifications can be made and the appended claims are intended to cover all such modifications which may fall within the spirit and scope of the disclosure.

What is claimed is:

1. A belt, comprising:

an inside belt surface, wherein the belt surface is a first material;

a belt coating layer provided on the inside belt surface, wherein the belt coating layer is a second material, wherein the first material and the second material are different; and a plurality of belt teeth in the belt coating layer.

2. The belt of claim 1 further comprising a plurality of belt adjustment slots between the plurality of belt teeth.

3. The belt of claim 1 wherein each of the plurality of belt teeth comprises a tab stop surface generally perpendicular to a plane of the inside belt surface.

4. The belt of claim 1 wherein each of the plurality of belt teeth comprises a sloped tab slide surface sloped relative to a plane of the inside belt surface.

5. The belt of claim 1 wherein each of the plurality of belt teeth comprises a tab stop surface generally perpendicular to a plane of the inside belt surface and a beveled tab slide surface opposite the tab stop surface and sloped relative to the plane of the inside belt surface.

6. The belt of claim 5 further comprising a generally planar tooth outer surface extending between the tab stop surface and the tab slide surface, the tooth outer surface generally parallel to the plane of the inside belt surface.

7. The belt of claim 1 wherein the inside belt surface comprises a webbing strap material and the belt coating layer comprises a moldable material.

8. The belt of claim 1 further comprising a generally elongated, rectangular belt groove in the inside belt surface, and wherein the plurality of belt teeth spans the belt groove.

9. A belt adjustment system, comprising:

a belt including:

an inside belt surface;

a belt coating layer provided on the inside belt surface; and a plurality of belt teeth in the belt coating layer;

a buckle, the buckle secured to the belt by a belt clamp;

a lever coupled to the buckle, the lever movable between at least a first position and a second position;

a tooth-engaging member, the tooth-engaging member positional between a tooth-engaging position and a tooth disengaging position responsive to moving the lever on the buckle, in the tooth engaging position the tooth-engaging member engages at least one of the plurality of belt teeth, and in the tooth-disengaging position the tooth engaging member is not engaged with at least one of the plurality of belt teeth; and a tab biasing mechanism normally biasing the tooth-engaging member in the tooth engaging position.

10. The belt adjustment system of claim 9 further comprising a plurality of belt adjustment slots between the plurality of belt teeth.

11. The belt adjustment system of claim 9 wherein each of the plurality of belt teeth comprises a stop surface generally perpendicular to a plane of the inside belt surface.

12. The belt adjustment system of claim 9 wherein each of the plurality of belt teeth comprises a sloped slide surface sloped relative to a plane of the inside belt surface.

13. The belt adjustment system of claim 9 wherein each of the plurality of belt teeth comprises a stop surface generally perpendicular to a plane of the inside belt surface and a beveled slide surface opposite the stop surface and sloped relative to the plane of the inside belt surface.

14. The belt adjustment system of claim 13 further comprising a generally planar tooth outer surface extending between the stop surface and the slide surface, the tooth outer surface generally parallel to the plane of the inside belt surface.

15. The belt adjustment system of claim 9 wherein the inside belt surface comprises a webbing strap material and the belt coating layer comprises a moldable material.

16. The belt adjustment system of claim 9 further comprising a generally elongated, rectangular belt groove in the inside belt surface, and wherein the plurality of belt teeth spans the belt groove.

17. The belt of claim 1, wherein the first material is nylon.

18. The belt of claim 1, wherein the second material is deformable material.

19. The belt of claim 18, wherein the second material is rubber material.

* * * * *